US009154864B1

(12) United States Patent
Sell

(10) Patent No.: US 9,154,864 B1
(45) Date of Patent: Oct. 6, 2015

(54) SPEAKER ASSEMBLY

(71) Applicant: Harman International Industries, Incorporated, Stamford, CT (US)

(72) Inventor: David J. Sell, White Lake, MI (US)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 14/265,689

(22) Filed: Apr. 30, 2014

(51) Int. Cl.
*H04R 1/02* (2006.01)
*H04R 31/00* (2006.01)

(52) U.S. Cl.
CPC ..... *H04R 1/02* (2013.01); *H04R 1/025* (2013.01); *H04R 1/026* (2013.01); *H04R 31/006* (2013.01); *H04R 1/021* (2013.01); *H04R 2201/02* (2013.01); *H04R 2400/11* (2013.01)

(58) Field of Classification Search
CPC ..... H04R 1/02; H04R 1/021; H04R 1/023; H04R 1/025; H04R 1/026; H04R 9/00; H04R 9/02; H04R 31/006; H04R 2201/02; H04R 2201/021; H04R 2201/029; H04R 2400/07; H04R 2400/11
USPC ..... 381/386, 395, 361, 366, 396, 433; 181/198, 199
See application file for complete search history.

(56) References Cited

U.S. PATENT DOCUMENTS

| | | | | |
|---|---|---|---|---|
| 2,894,182 | A | 7/1959 | Zuerker et al. | |
| 3,133,162 | A * | 5/1964 | Coen | 381/433 |
| 3,614,335 | A * | 10/1971 | Dymoke-Bradshaw et al. | 381/398 |
| 4,520,237 | A * | 5/1985 | Murakami | 381/412 |
| 4,752,963 | A | 6/1988 | Yamazaki et al. | |
| 4,815,558 | A * | 3/1989 | Krainhofer | 181/141 |
| 4,852,178 | A * | 7/1989 | Inkman et al. | 381/395 |
| 5,150,419 | A * | 9/1992 | Kizak et al. | 381/412 |
| 5,416,283 | A * | 5/1995 | Dault et al. | 181/150 |
| 6,075,866 | A * | 6/2000 | Frasl et al. | 381/177 |
| 6,178,252 | B1 * | 1/2001 | Frasl et al. | 381/424 |
| 7,079,665 | B2 * | 7/2006 | Shimomura et al. | 381/433 |
| 7,167,573 | B2 * | 1/2007 | Williamson | 381/403 |
| 7,822,221 | B2 * | 10/2010 | Watanabe | 381/394 |
| 7,873,178 | B2 * | 1/2011 | Steere et al. | 381/399 |
| 7,995,785 | B2 * | 8/2011 | Royse | 381/386 |
| 8,335,337 | B2 * | 12/2012 | Proni | 381/403 |
| 2001/0017930 | A1 * | 8/2001 | Matsudo et al. | 381/412 |
| 2002/0044671 | A1 * | 4/2002 | Shimomura et al. | 381/386 |
| 2009/0060250 | A1 * | 3/2009 | Proni | 381/396 |

* cited by examiner

*Primary Examiner* — Curtis Kuntz
*Assistant Examiner* — Joshua A Kaufman
(74) *Attorney, Agent, or Firm* — Brooks Kushman P.C.

(57) ABSTRACT

A speaker assembly includes a shellpot for receiving a speaker motor, the shellpot having a groove extending along an outer surface thereof. The speaker assembly further includes a speaker basket with a base portion having an opening therein for receiving the shellpot, the speaker basket including a plurality of flexible tabs substantially surrounding a perimeter of the opening, wherein the plurality of tabs are received in the groove to couple the shellpot to the speaker basket.

19 Claims, 5 Drawing Sheets

SPEAKER ASSEMBLY

TECHNICAL FIELD

Embodiments relate to a speaker assembly including a shellpot coupled with a speaker basket.

BACKGROUND

Plastic speaker baskets may be used to reduce weight and provide a low cost structure for certain speaker applications. Typically, plastic speaker baskets are molded directly over a metallic speaker shellpot, and then the rest of the speaker components are assembled in relation to the shellpot. However, the shellpot geometry often changes based on the design of the speaker assembly. Accordingly, new tooling, such as a new mold or mold detail, must be produced for each shellpot design, as well as each set of production tooling. As such, supporting multiple speaker designs can significantly increase manufacturing cost and complexity.

Some previous designs have accomplished attaching the shellpot to the plastic basket using either a twist lock design and/or using an adhesive to bond the shellpot to the plastic speaker basket. Although such designs allow the attachment of any of multiple shellpots to a common plastic basket, these designs may have insufficient durability for some applications. Further, a twisting or locking detail may lead to increased tooling complexity and manufacturing issues.

SUMMARY

In one embodiment, a speaker assembly includes a shellpot for receiving a speaker motor, the shellpot having a groove extending along an outer surface thereof. The speaker assembly further includes a speaker basket with a base portion having an opening therein for receiving the shellpot, the speaker basket including a plurality of flexible tabs substantially surrounding a perimeter of the opening, wherein the plurality of tabs are received in the groove to couple the shellpot to the speaker basket.

In another embodiment, a speaker assembly includes a shellpot for receiving a speaker motor, the shellpot including an upper portion and a lower portion, the upper portion including a groove extending along an outer surface thereof. The speaker assembly further includes a speaker basket with a base portion having an opening therein for receiving the shellpot. The speaker basket includes a plurality of flexible tabs extending upwardly from the base portion and surrounding at least about 75% of a perimeter of the opening, each tab tapering along its width from a central portion thereof to a peripheral portion thereof. The plurality of tabs are received in the groove to couple the shellpot to the speaker basket.

In another embodiment, a speaker assembly includes a speaker motor and a shellpot for receiving the speaker motor, the shellpot including a groove extending along an outer surface thereof. The speaker assembly further includes a speaker basket with a base portion having an opening therein for receiving the shellpot, the speaker basket including a plurality of flexible tabs substantially surrounding a perimeter of the opening, wherein the plurality of tabs are received in the groove to couple the shellpot to the speaker basket.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
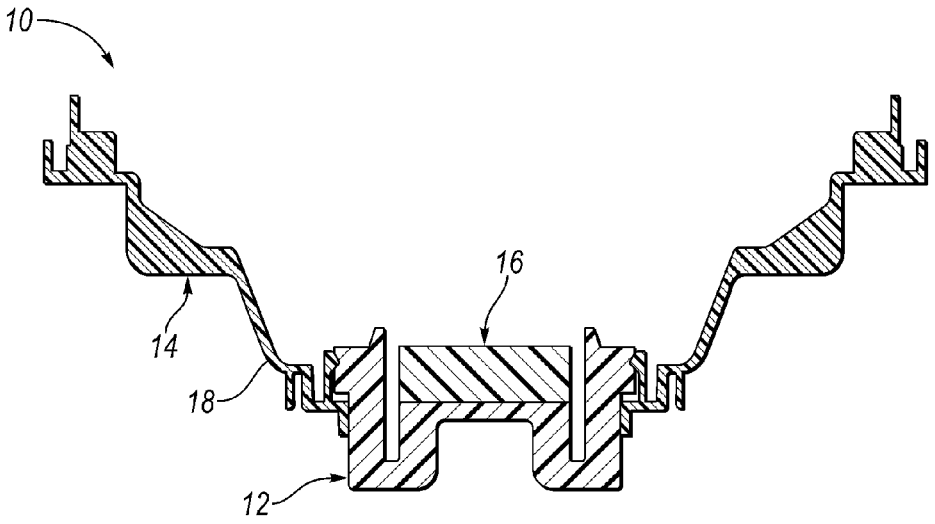
FIG. 1 is a cross-sectional view of a speaker assembly according to an embodiment.

As illustrated in FIG. 1, a speaker assembly 10 according to an embodiment may include a shellpot 12, a speaker basket 14 for receiving and supporting the shellpot 12, and at least one speaker motor 16 received in the shellpot 12. The speaker basket 14 may be formed of a plastic material, for example a polycarbonate material or any other thermoplastic resin-based material. The shellpot 12 may be constructed from a metallic material or other rigid material. As is known in the art, the speaker motor 16 may comprise an assembly including a back plate or center pole, a permanent magnet, and a front or top plate that may provide a substantially uniform magnetic field across an air gap, and a voice coil former may support a voice coil in the magnetic field (components not shown). Other speaker components may alternatively or additionally be included in the speaker assembly 10.

Figure 2:
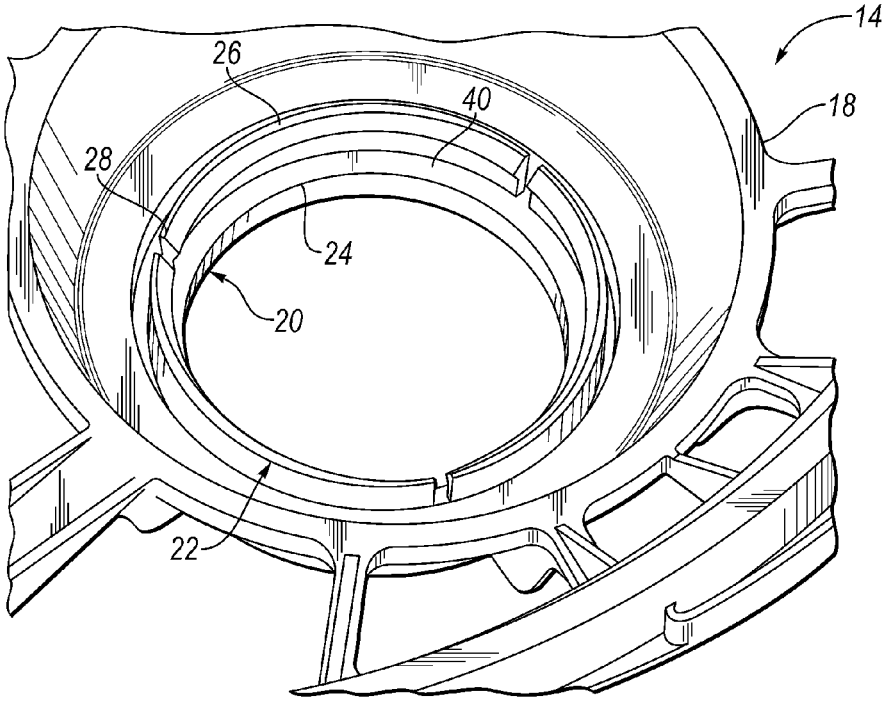
FIG. 2 is a perspective, cut-away view of a shellpot coupled with a speaker basket according to an embodiment.
Figure 8:
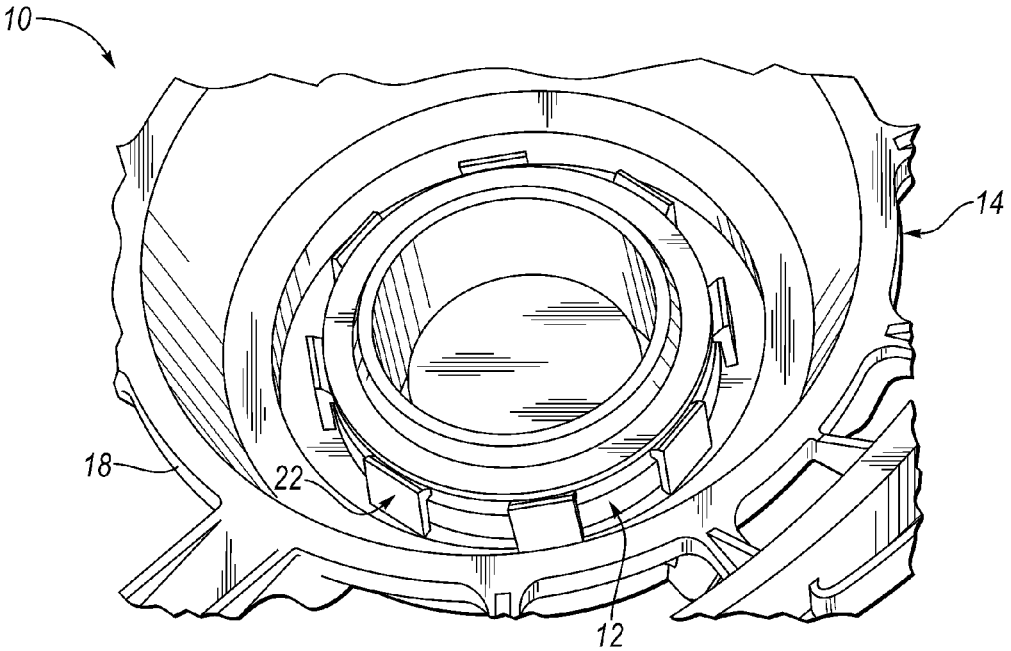
FIG. 8 is a perspective view of a shellpot coupled with a speaker basket according to another embodiment.

With reference to FIGS. 1 and 2, the speaker basket 14 includes a base portion 18 having an opening 20 therein for receiving the shellpot 12. A plurality of flexible tabs 22 is arranged circumferentially around the opening 20 so as to substantially surround a perimeter 24 of the opening 20. In one embodiment, the tabs 22 extend upwardly from the base portion 18 into an interior of the speaker basket 14, although the position of the tabs 22 is not limited to this configuration. While four tabs 22 are illustrated in FIG. 2, other numbers of tabs 22 are also contemplated. For example, an embodiment of the speaker assembly 10 wherein eight tabs 22 are employed is depicted in FIG. 8.

In one non-limiting embodiment, the plurality of tabs 22 may occupy at least about 75% of the opening perimeter 24. In another embodiment, the tabs 22 may occupy at least about 85% of the perimeter 24, and in still another embodiment the tabs 22 may occupy at least about 95% of the perimeter 24. The substantial proportion of the opening perimeter 24 that the tabs 22 comprise may serve to increase the strength of the coupling between the shellpot 12 and the speaker basket 14. With reference again to FIG. 2, each tab 22 may taper along its width from a central portion 26 thereof outwardly to peripheral portions 28 thereof. Such a configuration may provide more flexibility at the ends 28 of the tabs 22 and more rigidity and strength in the center 26 of the tabs 22, thus facilitating insertion of the shellpot 12 into the speaker basket 14 while still retaining structural integrity of the tabs 22.

Figure 3:
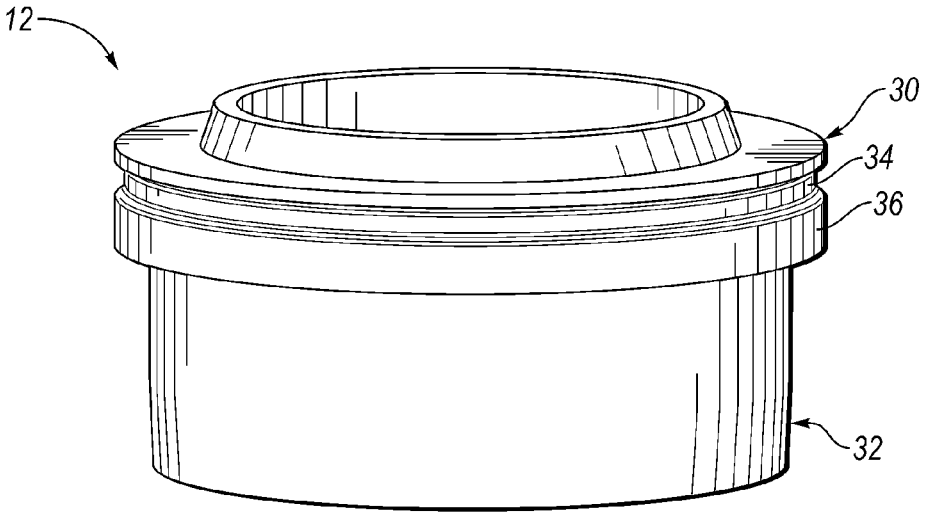
FIG. 3 is a top perspective view of a speaker basket according to an embodiment.

As best shown in FIG. 3, the shellpot 12 includes an upper portion 30 and a lower portion 32. In the embodiment shown, the upper portion 30 has a greater diameter than a diameter of the lower portion 32, although the shellpot 12 is not limited to this configuration as described below. The shellpot 12 includes an indentation or groove 34 formed along an outer surface 36 of the shellpot 12, the groove 34 extending at least partially circumferentially around the shellpot 12. In one embodiment, the groove 34 may be formed on the shellpot upper portion 30.

In order to assemble the shellpot 12 to the speaker basket 14, the shellpot 12 is pressed and snap-fit into the speaker basket 14. The shellpot 12 may be received into the opening 20, such as from the interior of the speaker basket 14, such that the plurality of tabs 22 flex outward as the shellpot 12 is inserted. The tabs 22 then flex back inward and are received in the groove 34 to couple the shellpot 12 to the speaker basket 14. In further detail, each tab 22 may include a detent 38 extending along a width of the tab 22, where the detent 38 is sized to be received in the groove 34. The tabs 22 provide pressure on the shellpot 12 from the outside inward in order to securely retain the shellpot 12 in the speaker basket 14 without requiring the use of adhesives or other fasteners or securing mechanisms. In this way, the shellpot 12 and speaker basket 14 can be fastened together easily and securely, and the assembly operation can proceed without needing to allot any time required for adhesive material to harden or additional fasteners to be installed.

Figure 4:
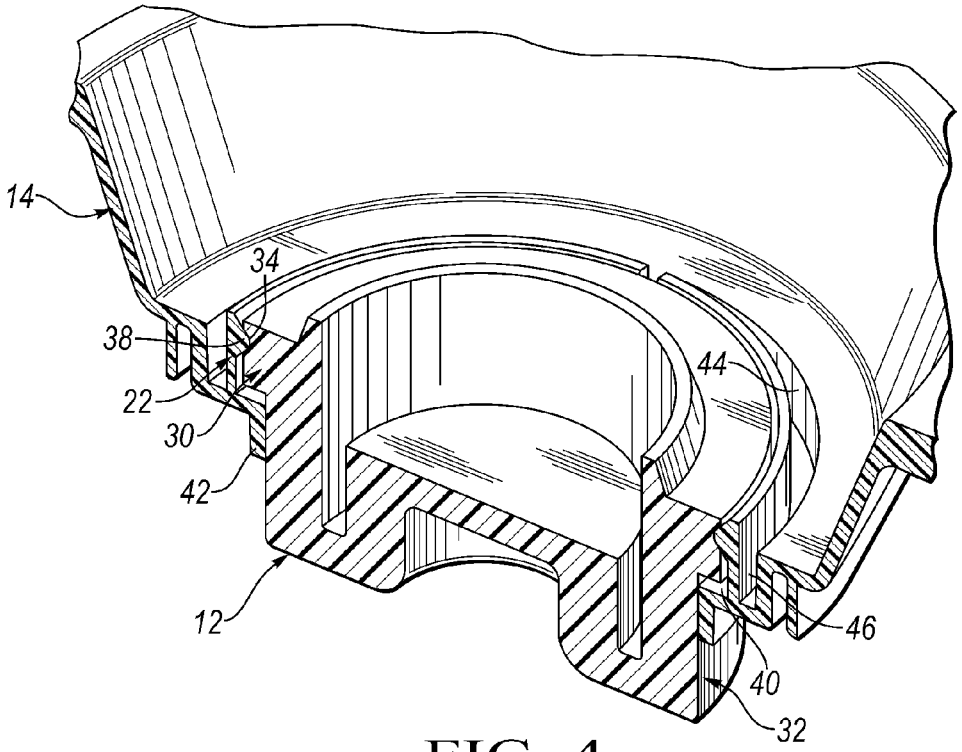
FIG. 4 is a perspective view of a shellpot according to an embodiment.

With reference to FIGS. 2-4, the speaker basket 14 may include a lip 40 surrounding the opening 20, and the plurality of flexible tabs 22 may be positioned outwardly from the opening 20. When the shellpot 12 is coupled to the speaker basket 14, the lip 40 is disposed below the shellpot upper portion 30 (see FIG. 4). In addition, the speaker basket 14 may include a flange 42 extending downwardly from the opening 20, wherein the flange 42 engages the shellpot lower portion 32 when the shellpot 12 is coupled with the speaker basket 14 (see FIG. 4). Both the lip 40 and flange 42 may serve to further stabilize and strengthen the coupling of the shellpot 12 and speaker basket 14.

Figure 5:
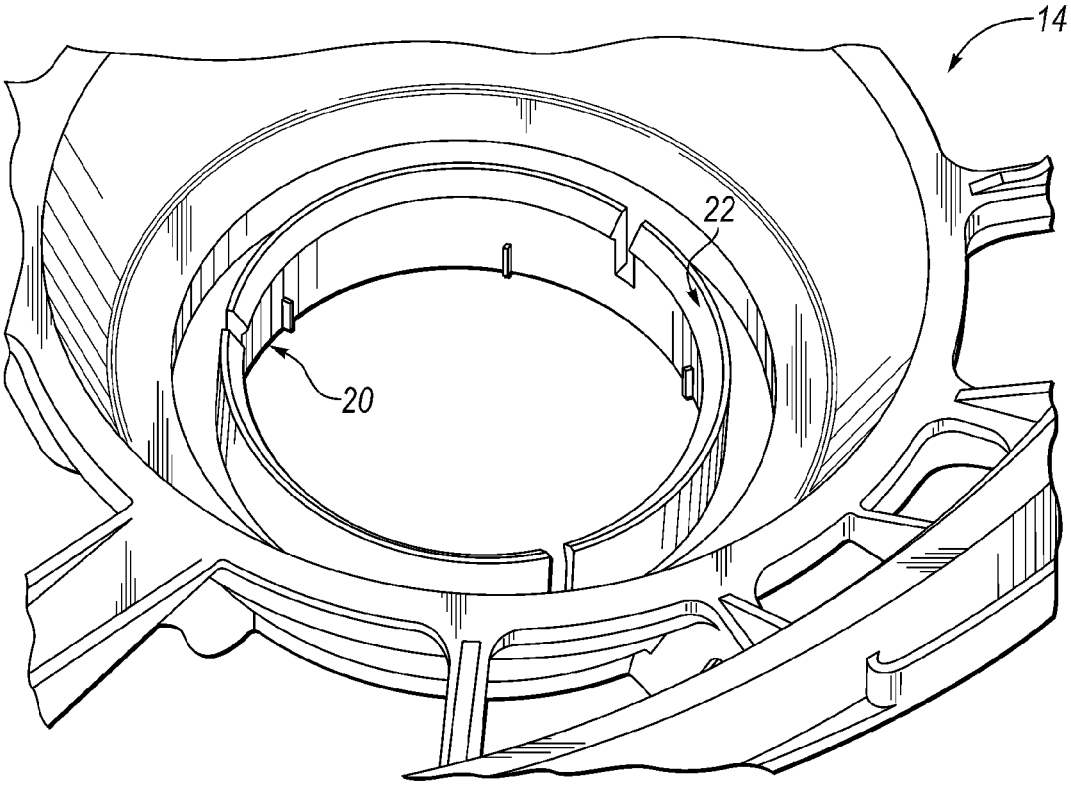
FIG. 5 is a top perspective view of another embodiment of a speaker basket.
Figure 6:
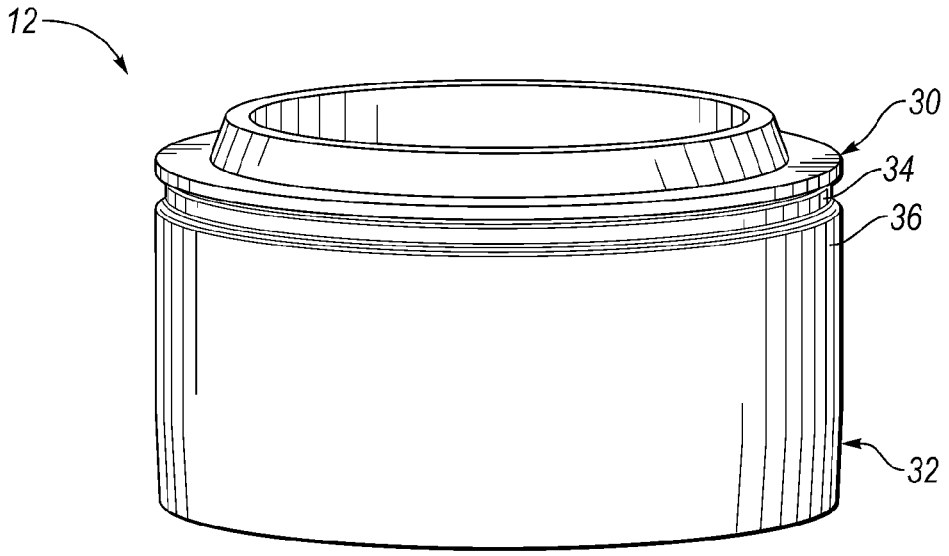
FIG. 6 is a perspective view of a shellpot according to another embodiment.
Figure 7:
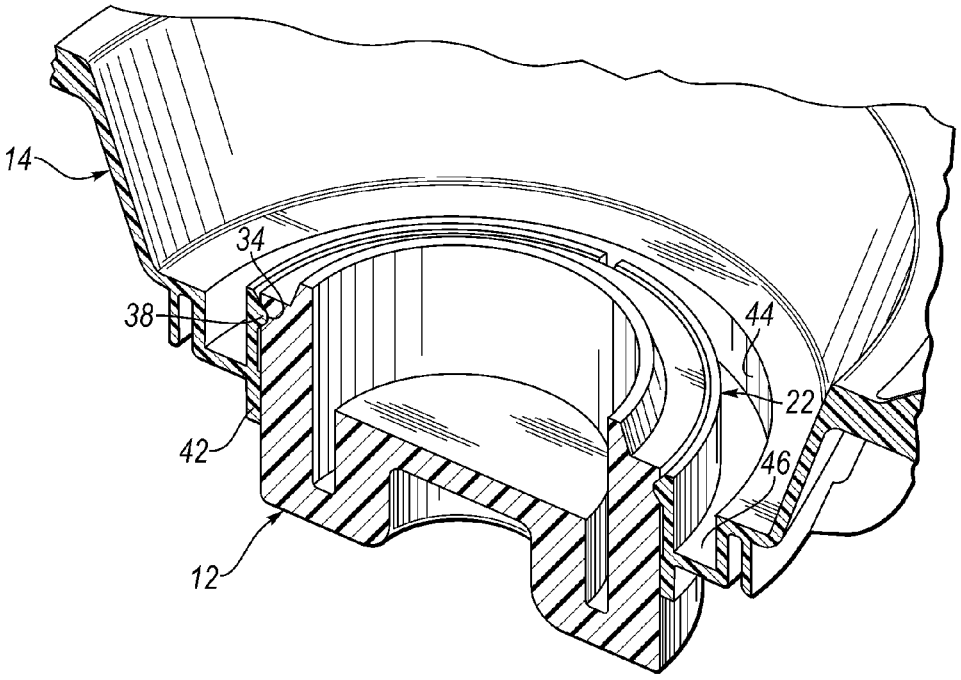
FIG. 7 is a perspective, cut-away view of a shellpot coupled with a speaker basket according to an embodiment.

In another embodiment illustrated in FIGS. 5-7, the upper and lower shellpot portions 30, 32 may have substantially the same diameters. In this embodiment, the plurality of flexible tabs 22 extend directly upward from the opening 20 along the perimeter 24, where the tabs 22 engage the groove 34 upon assembly of the shellpot 12 and speaker basket 14 as described above.

Figure 9:
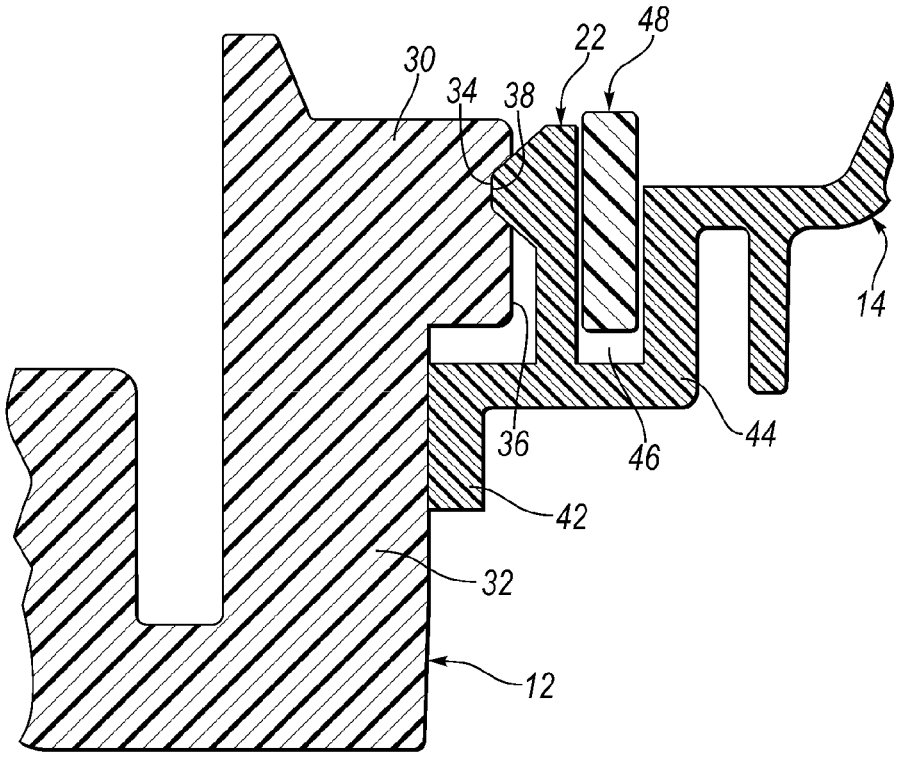
FIG. 9 is a cross-sectional view depicting a shim positioned between the tabs and the wall of the speaker basket.

As shown in FIGS. 4, 7 and 9, the speaker basket 14 may include a wall 44 spaced outwardly from and at least surrounding the plurality of tabs 22, wherein a gap 46 is defined between the tabs 22 and the wall 44. In one embodiment, the wall 44 and the plurality of tabs 22 may have approximately the same height. To further increase the security of the coupling attachment between the shellpot 12 and the speaker basket 14, after assembly of the shellpot 12 into the speaker basket 14, a shim 48 may be inserted in the gap 46 between the tabs 22 and the wall 44 in order to substantially fill the gap 46 and provide additional outward pressure for engagement of the tabs 22 with the groove 34 of the shellpot 12 (see FIG. 9).

In one embodiment, the shim 48 may comprise a ring element, constructed from a metallic or plastic material, which surrounds all of the tabs 22. In another embodiment, the shim 48 may comprise a plurality of elements inserted in engagement with at least some of the tabs 22 and at least a portion of the wall 44. In yet another embodiment, the shim 48 may comprise an adhesive material which substantially fills the gap between the tabs 22 and the wall 44. In any form, the shim 48 may serve to further to keep the tabs 22 from disengaging from the shellpot groove 38 by preventing outward flexing of the tabs 22 after assembly has occurred.

Therefore, coupling the shellpot 12 to the speaker basket 14 using flexible tabs 22 as described herein provides a secure attachment interface which does not require adhesive or additional fasteners. This attachment interface also allows for the use of multiple shellpot 12 configurations and, thus speaker motor 16 designs, with a single speaker basket 14, thereby reducing manufacturing complexity and cost of the speaker assembly 10.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A speaker assembly, comprising:

a shellpot for receiving a speaker motor, the shellpot including a groove extending along an outer surface thereof; and a speaker basket including a base portion having an opening therein for receiving the shellpot, the speaker basket including a plurality of flexible tabs substantially surrounding a perimeter of the opening, each tab having a width extending along a circumference of the opening wherein the tab tapers along the width from a central portion to peripheral portions at both ends thereof, wherein the plurality of tabs are received in the groove to couple the shellpot to the speaker basket.

2. The speaker assembly of claim 1, wherein the plurality of tabs extend upwardly from the base portion.

3. The speaker assembly of claim 1, wherein the plurality of tabs occupy at least about 75% of the perimeter of the opening.

4. The speaker assembly of claim 1, wherein the shellpot includes an upper portion and a lower portion, and the groove is formed on the upper portion.

5. The speaker assembly of claim 4, wherein the upper portion has a greater diameter than a diameter of the lower portion.

6. The speaker assembly of claim 1, wherein the speaker basket includes a lip surrounding the opening, and the plurality of flexible tabs are positioned outwardly from the opening, wherein the lip is disposed below a shellpot upper portion when the shellpot is coupled to the speaker basket.

7. The speaker assembly of claim 1, wherein the speaker basket includes a flange extending downwardly from the opening, wherein the flange engages a shellpot lower portion when the shellpot is coupled with the speaker basket.

8. The speaker assembly of claim 1, wherein the speaker basket includes a wall spaced outwardly from and at least partially surrounding the plurality of tabs, and a gap is defined between the tabs and the wall.

9. The speaker assembly of claim 8, further comprising a shim inserted in the gap to engage at least some of the plurality of tabs and at least a portion of the wall to prevent outward flexing of the tabs.

10. The speaker assembly of claim 9, wherein the shim comprises a ring element.

11. The speaker assembly of claim 9, wherein the shim comprises an adhesive material.

12. The speaker assembly of claim 1, wherein the speaker basket is constructed from a plastic material and the shellpot is constructed from a metallic material.

13. A speaker assembly, comprising:

a shellpot for receiving a speaker motor, the shellpot including an upper portion and a lower portion, the upper portion including a groove extending along an outer surface thereof; and a speaker basket including a base portion having an opening therein for receiving the shellpot, the speaker basket including a plurality of flexible tabs extending upwardly from the base portion and surrounding at least about 75% of a perimeter of the opening, each tab having a width extending along a circumference of the opening wherein the tab tapers along the width from a central portion thereof outwardly to peripheral portions at both ends thereof, wherein the plurality of tabs are received in the groove to couple the shellpot to the speaker basket.

14. The speaker assembly of claim 13, wherein the upper portion has a greater diameter than a diameter of the lower portion.

15. The speaker assembly of claim 13, wherein the speaker basket includes a lip surrounding the opening, and the plurality of flexible tabs are positioned outwardly from the opening, wherein the lip is disposed below the shellpot upper portion when the shellpot is coupled to the speaker basket.

16. The speaker assembly of claim 13, wherein the speaker basket includes a flange extending downwardly from the opening, wherein the flange engages the shellpot lower portion when the shellpot is coupled with the speaker basket.

17. The speaker assembly of claim 13, wherein the speaker basket includes a wall spaced outwardly from and at least partially surrounding the plurality of tabs, and a gap is defined between the tabs and the wall.

18. The speaker assembly of claim 17, further comprising a shim inserted in the gap following coupling of the shellpot to the speaker basket, the shim engaging at least some of the plurality of tabs and at least a portion of the wall to prevent outward flexing of the tabs.

19. A speaker assembly, comprising:

a speaker motor;

a shellpot for receiving the speaker motor, the shellpot including a groove extending along an outer surface thereof; and a speaker basket including a base portion having an opening therein for receiving the shellpot, the speaker basket including a plurality of flexible tabs substantially surrounding a perimeter of the opening, each tab having a width extending along a circumference of the opening wherein the tab tapers along the width from a central portion to peripheral portions at both ends thereof, wherein the plurality of tabs are received in the groove to couple the shellpot to the speaker basket.

* * * * *